US006908287B2

(12) United States Patent
Cho et al.

(10) Patent No.: US 6,908,287 B2
(45) Date of Patent: Jun. 21, 2005

(54) AXIAL FLOW FAN

(75) Inventors: Kyung Seok Cho, Taejon-Si (KR); Ok Ryul Min, Taejon-Si (KR); Chang Ho Park, Taejon-Si (KR)

(73) Assignee: Halla Climate Control Corp., Taejon-si (KR)

( * ) Notice: Subject to any disclaimer, the term of this patent is extended or adjusted under 35 U.S.C. 154(b) by 362 days.

(21) Appl. No.: 10/167,990

(22) Filed: Jun. 10, 2002

(65) Prior Publication Data

US 2003/0012656 A1 Jan. 16, 2003

(30) Foreign Application Priority Data

Jun. 12, 2001 (KR) ..... 2001-32756
Jun. 12, 2001 (KR) ..... 2001-32757

(51) Int. Cl.[7] ..... F04D 29/38

(52) U.S. Cl. ..... 416/189; 416/169 A; 416/228; 416/237; 416/238; 416/242; 416/DIG. 2; 416/DIG. 5; 415/119

(58) Field of Search ..... 415/119; 416/189, 416/169 A, 192, 228, 238, DIG. 2, DIG. 5, 242, 235, 236 R, 236 A, 237; 123/41.49, 41.65, 41.66

(56) References Cited

U.S. PATENT DOCUMENTS 632,740 A * 9/1899 Parker ..... 416/228
4,089,618 A 5/1978 Patel
4,569,631 A 2/1986 Gray, III
4,684,324 A 8/1987 Perosino
5,603,607 A 2/1997 Kondo et al.
5,906,179 A 5/1999 Capdevila

* cited by examiner

*Primary Examiner*—Christopher Verdier
(74) *Attorney, Agent, or Firm*—Lowe Hauptman & Berner, LLP

(57) ABSTRACT

Disclosed is an axial flow fan capable of achieving reduction of noise while having a high blowing efficiency compared to the power consumption of a motor adapted to drive the axial flow fan. The axial flow fan includes a hub, and a plurality of blades extending radially around the hub. Each blade has a sweep angle varying gradually from a backward angle at a root of the blade connected to the hub to a forward angle at a tip of the blade, while having a flow dispersion region having a plurality of regions where the sweep angle is alternately changed, at a region defined between a backward sweep angle region at the root of the blade and a forward sweep angle region at the tip of the blade. Each blade has a longitudinal cross section curved to have a wave structure between the root of the blade and the tip of the blade. The axial flow fan may further include a fan band connecting tips of the blades. The axial flow fan achieves reduction of blowing noise by receiving air in a dispersed state at the leading edge of each blade, discharging air in a dispersed state at the trailing edge of each blade, and offsetting turbulent flows of air by virtue of the wave-shaped longitudinal cross-sectional structure of each blade.

11 Claims, 15 Drawing Sheets

AXIAL FLOW FAN

BACKGROUND OF THE INVENTION

1. Field of the Invention

The present invention relates to an axial flow fan for axially moving air, and more particularly to an axial flow fan capable of achieving reduction of noise while having a high blowing efficiency compared to the power consumption of a motor adapted to drive the axial flow fan.

2. Description of the Related Art

Generally, axial flow fans are configured to axially move air while rotating in accordance with the driving operation of a drive motor. Such an axial flow fan may be effectively used in motor vehicles to promote heat discharge of a heat exchanger such as a radiator or condenser.

Referring to FIGS. 7 and 8, an axial flow fan for a motor vehicle is illustrated. As shown in FIGS. 7 and 8, this axial flow fan includes a hub 1 coupled to the drive shaft of a drive motor, and a plurality of blades 2 extending radially around the hub 1. The axial flow fan for motor vehicles may also selectively include an annular fan band 3 surrounding the blades 2 while connecting tips of the blades 2 together. The annular fan band 3 serves to guide a radial flow of air in an axial direction, thereby obtaining an enhanced axial blowing efficiency. The annular fan band 3 also supports the blades 2 so as to avoid a deformation of those blades 2.

In such an axial flow fan configuration, each blade 2, which is configured to directly guide air in an axial direction, has a streamlined cross-sectional structure. Each blade 2 sucks air from the upstream side of the axial flow fan and discharges the sucked air toward the downstream side of the axial flow fan by virtue of an increase in pressure occurring at the pressure surface of the blade when it rotates, thereby blowing air. The structure of the blade has a great influence on the blowing efficiency and noise of the axial flow fan.

In particular, axial flow fans for motor vehicles should meet various performance requirements for different applications thereof, respectively.

For example, in the case of an axial flow fan used in a motor vehicle, it is used to cool a radiator adapted to cool the engine of the motor vehicle, and a condenser adapted to improve the performance of an air conditioner. In this case, the axial flow fan has to generate a sufficient amount of air flow to cool the heat exchangers while withstanding loads applied to the heat exchangers, that is, static pressure drops. Also, the axial flow fan should exhibit a high blowing efficiency compared to the power consumption of its motor, taking into consideration problems related to vehicle battery capacity due to a recent tendency to mount an increased number of electronic appliances to vehicles. Moreover, the axial flow fan should generate a reduced level of noise to meet the standing rule for the reduction of noise. In addition, the axial flow fan should not be damaged even when it rotates at high speed.

In designing an axial flow fan having a configuration meeting the above mentioned performance requirements, the shape, width, and mounting angle of blades are handled as important design factors because those blades have a great influence on blowing efficiency and generation of noise.

As shown in FIGS. 7 and 9, conventional axial flow fans have blades 2 each swept in a rotating direction. The sweeping degree of the blade 2 in a rotating direction, that is, the sweep angle $\sigma_r$, is increased as the blade 2 extends radially toward its tip 2*b* (for example, the blade portion connected to a fan band 3 where the fan band 3 is installed). Thus, conventional axial flow fans selectively have either forward blades having a structure in which each blade is swept in a rotating direction, or backward blades having a structure in which each blade is swept in a direction opposite to the rotating direction.

For example, an axial flow fan having forward blades will be described with reference to FIG. 9. As shown in FIG. 9, this axial flow fan includes blades 2 each having a structure in which a leading edge LE, that is, the end of the blade 2 in a rotating direction, a trailing edge TE, that is, the end of the blade 2 in a direction opposite to the rotating direction, and a median line ML between the leading and trailing edges LE and TE are swept in the direction opposite to the rotating direction of the fan at a root 2*a* of the blade 2 secured to a hub 1 while being swept in the rotating direction as they extend from the root 2*a* to a tip 2*b* of the blade 2. That is, the sweep angle $\sigma_r$, which is defined as an angle between a radius line R extending from the center of the hub 1 through an arbitrary point and a tangent line TL at the optional point and represents a slope of the blade 2 in the rotating direction, is backward (–) at the root 2*a* of the blade 2, while being inflected at a particular point IP (hereinafter, referred to as an "inflection point") spaced away from the blade root 2*a*, to be forward (+) at the tip 2*b* of the blade 2. That is, the blade 2 of the axial flow fan has a backward sweep angle $\sigma_r$ ($\sigma_r<0$) at a root region thereof (that is, a region radially inward of the inflection point IP of the blade 2) while having a forward sweep angle $\sigma_r$ ($\sigma_r>0$) at a tip region thereof (that is, a region positioned radially outwardly of the inflection point IP of the blade 2).

In such an axial flow fan, a flow concentration region C is formed near the inflection point IP of each blade where the sweep angle $\sigma_r$ of the blade is changed from backward to forward. By virtue of the flow concentration region C, the axial flow fan has been appreciated as generating less noise, as compared to other axial flow fans.

U.S. Pat. No. 4,569,631 discloses an axial flow fan including blades having a sweep angle of at least 30°. Also, U.S. Pat. No. 4,684,324 discloses an axial flow fan including blades having a structure wherein the inflection point of each blade is defined within the range of 0.25 to 0.5 of the non-dimensional radius of the blade.

Although the conventional axial flow fans have the above mentioned forward or backward-swept blade structures, they cannot provide a satisfactory noise reduction effect. In order to achieve a quiet running of motor vehicles, therefore, development of an axial flow fan capable of achieving a satisfactory noise reduction has been strongly required.

To meet such a requirement, U.S. Pat. No. 5,906,179 has proposed an axial flow fan wherein each blade has a chord length, that is, the distance between the leading and trailing edges of the blade, which varies depending on a variation in the length of the blade, such that the chord length has a minimum value at a predetermined location. Also, U.S. Pat. Nos. 5,603,607 and 4,089,618 have proposed an axial flow fan having a blade trailing edge of a sawtooth shape.

Although the conventional axial flow fans respectively having the above mentioned blade structures achieve a limited reduction of noise, they cannot provide a satisfactory noise reduction effect. For this reason, where such axial flow fans are applied to a motor vehicle, they degrade a desired quiet running of the motor vehicle.

SUMMARY OF THE INVENTION

The present invention generally provides an axial flow fan capable of achieving reduction of noise while having a high blowing efficiency compared to the power consumption of a motor adapted to drive the axial flow fan.

One aspect of the present invention provides a fan comprising: a hub configured to rotate about an axis; at least one blade extending from the hub generally in a radial direction of the hub, the blade comprising a leading edge and a trailing edge, wherein an imaginary median line is defined between the leading and trailing edges, the blade further comprising inner, middle and outer portions, the inner portion being directly attached to the hub, the middle portion being interposed between the inner and outer portions; and wherein the inner portion has a sweep angle below zero. The outer portion has a sweep angle above zero, and wherein the sweep angle is measured in the rotational direction between the radial direction and a tangential direction away from the hub at a point on the median line. The middle portion has a sweep angle varying between below zero and above zero at least twice. The sweep angle varies between below zero and above zero a plurality of times. The blade has a length in the radial direction from an inner-most end of the inner portion to an outer-most end of the outer portion, and wherein a length of the inner portion in the radial direction is from about 10% to about 20% of the length of the blade. The blade has a length in the radial direction from an inner-most end of the inner portion to an outer-most end of the outer portion, and wherein a length of the outer portion in the radial direction is from about 20% to about 30% of the length of the blade. The blade has a length in the radial direction from an inner-most end of the inner portion to an outer-most end of the outer portion, and wherein the middle portion begins from about 15% of the length of the blade in a radial distance from the inner-most end of the inner portion. The blade has a length in the radial direction from an inner-most end of the inner portion to an outer-most end of the outer portion, and wherein the middle portion extends up to about 75% of the length of the blade in a radial distance from the inner-most end of the inner portion.

The fan's leading edge is curved with a plurality of points of inflexion. The trailing edge is curved with a plurality of waves. The leading and trailing edges are curved such that overall curvatures of the leading and trailing edges are substantially similar to each other along the radial direction. The trailing edge has a contour substantially identical to a contour of the median line. The inner portion, the middle portion, and the outer portion are connected by smooth curves. The fan further comprises a fan band, wherein the outer portion of the blade is attached to the fan band. An absolute value of the sweep angle is the highest at either an inner-most end or an outer-most end of the blade in the radial direction of the hub. An absolute value of the sweep angle in the middle portion is equal to or less than about ⅔ of the highest absolute value of the sweep angle. The blade further comprises two opposing surfaces, and wherein at least one of the surfaces is substantially non-planar. The blade further comprises two opposing surfaces, and wherein at least one of the surfaces is undulate in both directions of the axis.

Another aspect of the present invention provides am axial flow fan. The fan comprises: a hub configured to rotate about a central axis in a rotational direction; and at least one blade attached to the hub, the blade being configured to rotate about the axis and to generate an axial flow of air while rotating, the blade comprising a leading edge having at least two points of inflexion. The blade further comprises means for canceling noise elements generated by operation of the fan. The leading edge has three points of inflexion. The blade further comprises a trailing edge having at least two points of inflexion. Each point of inflexion of the leading and trailing edges is located at a radial distance from the axis, and wherein the at least two points of inflexion of the trailing edge are located at radial distances substantially identical to radial distances of the at least two points of inflexion of the leading edge. Tangential directions of the leading edge at radial distances from the axis are substantially like tangential directions of the trailing edge at the same radial distances. The blade further comprises a proximal end and a distal end in the radial direction, and wherein an angle in the rotational direction between the radial direction and a tangential direction away from the hub at the proximal end of the leading edge is below zero. The blade further comprises a proximal end and a distal end in the radial direction, and wherein an angle in the rotational direction between the radial direction and a tangential direction away from the hub at the distal end of the leading edge is above zero. Each point of the leading edge has a tangential direction away from the hub, and wherein an angle in the rotational direction between the radial direction and the tangential direction varies between below zero and above zero along the leading edge. The angle varies between below zero and above zero more than twice along the leading edge. The blade further comprises two opposing surfaces, and wherein at least one of the surfaces is undulate in both directions of the axis.

A further aspect of the present invention provides an axial flow fan, which comprises: a hub configured to rotate about an axis; and at least one blade attached to the hub and comprising two opposing surfaces, wherein at least one of the two surfaces has a wave pattern undulating in both directions of the axis along a radial direction of the fan. The blade further comprises means for canceling noise generated by operation of the fan. The undulating wave pattern comprises at least two waves. The two surfaces of the blade form a thickness thereof, and wherein the thickness is substantially identical throughout the blade. The undulating wave pattern is substantially sinusoidal. The substantially sinusoidal wave has a substantially constant wavelength along the radial direction. The substantially sinusoidal wave has a wavelength varying along the radial direction. The substantially sinusoidal wave has a wavelength increasing in the radial direction from the hub. The blade further comprises leading and trailing edges, and wherein the leading edge is curved with at least two points of inflexion. The trailing edge is curved with at least two points of inflexion. Contours of the leading and trailing edges are substantially alike along radial directions.

A further aspect of the present invention provides an axial flow fan including a hub, and a plurality of blades extending radially around the hub, wherein: each of the blades has a sweep angle varying gradually from a backward angle at a root of the blade connected to the hub to a forward angle at a tip of the blade; and each of the blades has a flow dispersion region having a plurality of regions where the sweep angle is alternately changed, at a region defined between a backward sweep angle region at the root of the blade and a forward sweep angle region at the tip of the blade.

Preferably, each of the blades has a leading edge extending from the root of the blade to the tip of the blade, and has a sweep angle varying gradually from a maximum backward angle at the root of the blade to a maximum forward angle at the tip of the blade while being alternately changed in direction at an intermediate portion of the leading edge from a backward direction, corresponding to a sweep direction at the root of the blade, to a forward direction, and then from the forward direction to the backward direction, so that the sweep angle is finally changed from the backward direction to the forward direction corresponding to a sweep direction at the tip of the blade. Accordingly, the region of the leading edge defined between an inflection region near the blade root and an inflection region near the blade tip serves as a flow dispersion region. That is, the leading edge of the blade has a wave structure.

In accordance with another aspect, the present invention provides an axial flow fan including a hub, and a plurality of blades extending radially around the hub, wherein: each of the blades has a sweep angle varying gradually from a forward angle at a root of the blade to a backward angle at a tip of the blade; and each of the blades has a flow dispersion region having a plurality of regions where the sweep angle is alternately changed, at a region defined between a forward sweep angle region at the root of the blade and a backward sweep angle region at the tip of the blade.

Preferably, each of the blades has a leading edge extending from the root of the blade to the tip of the blade, and has a sweep angle varying gradually from a maximum forward angle at the root of the blade to a maximum backward angle at the tip of the blade while being alternately changed in direction at an intermediate portion of the leading edge from a forward direction, corresponding to a sweep direction at the root of the blade, to a backward direction, and then from the backward direction to the forward direction, so that the sweep angle is finally changed from the forward direction to the backward direction corresponding to a sweep direction at the tip of the blade. Accordingly, the region of the leading edge defined between an inflection region near the blade root and an inflection region near the blade tip serves as a flow dispersion region.

In accordance with the present invention, the same sweep angle variation characteristics as those of the leading edge are preferably applied to a mid-chord line between the leading and trailing edges. The sweep angles of the leading and trailing edges in each blade have the same direction at each section of the blade. The trailing edge of each blade has a wave structure, as in the case of the leading edge. Accordingly, the blade has a wave structure in its entirety.

Preferably, the absolute value of the forward sweep angle in the flow dispersion region on the mid-chord line between leading and trailing edges of the each of the blades corresponds to ⅔ or less of the absolute value of the backward sweep angle at the root of the blade. Preferably, the absolute value of the backward sweep angle in the flow dispersion region corresponds to ⅔ or less of the absolute value of the forward sweep angle at the tip of the blade.

The flow dispersion region of each of the blades is defined within a range of 0.15 to 0.75 of a non-dimensional radius.

The axial flow fan of the present invention may further comprise a fan band connecting tips of the blades.

Preferably, the distance between the leading and trailing edges of each blade increases gradually as the blade extends from its root to its tip. Preferably, each blade has a longitudinal cross section curved to have a wave structure as it extends from its root to its tip.

The axial flow fan having the above described configuration according to the present invention achieves reduction of blowing noise by receiving air in a dispersed state at the leading edge of each blade, discharging air in a dispersed state at the trailing edge of each blade, and offsetting turbulent flows of air by virtue of the wave-shaped longitudinal cross-sectional structure of each blade.

BRIEF DESCRIPTION OF THE DRAWINGS

The features and advantages of the present invention will become more apparent after a reading of the following detailed description when taken in conjunction with the drawings, in which.

DESCRIPTION OF THE PREFERRED EMBODIMENTS

Figure 1A:
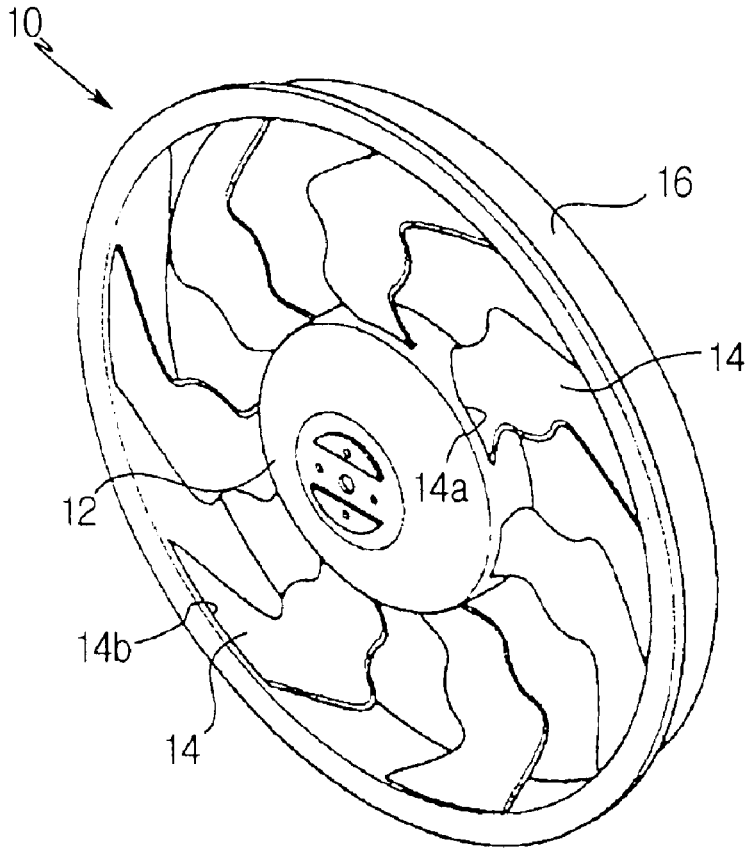
FIG. 1*a* is a perspective view illustrating an axial flow fan according to an embodiment of the present invention.
Figure 1B:
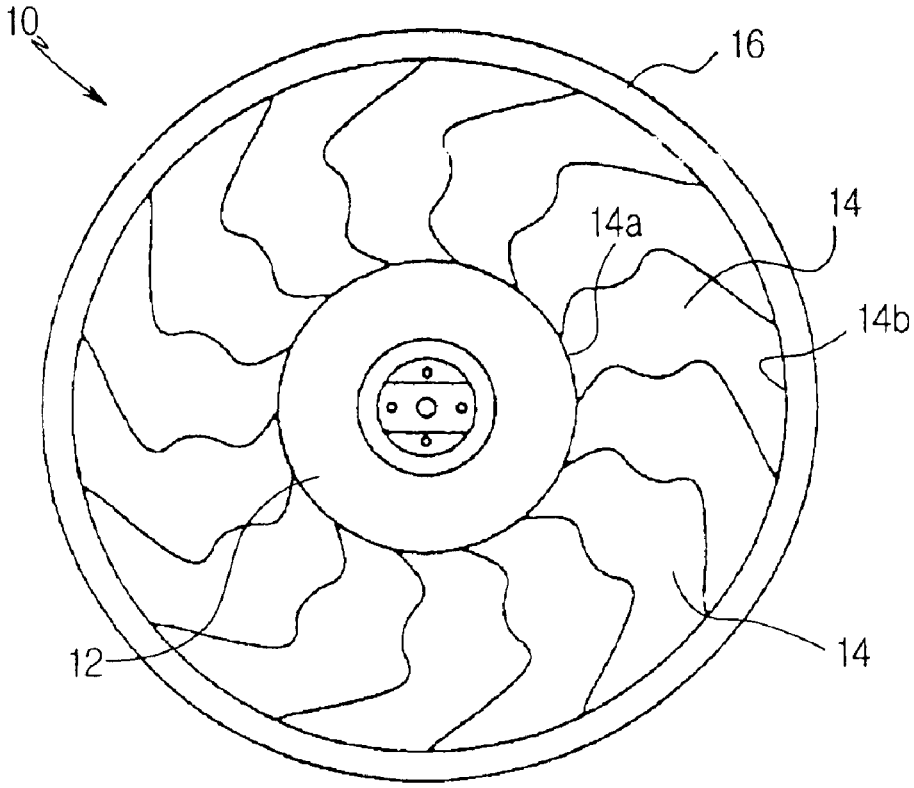
FIG. 1*b* is a front view corresponding to FIG. 1*a;*

Now, preferred embodiments of the present invention will be described in detail with reference to the attached drawings.

Axial flow fans according to the present invention are illustrated in FIGS. 1*a* and 1*b*, and FIGS. 2*a* and 2*b*. In either case of FIGS. 1*a* and 1*b* or FIGS. 2*a* and 2*b*, the axial flow fan, which is denoted by the reference numeral 10, includes a hub 12 coupled to the shaft of a motor (not shown), and a plurality of blades 14 extending radially around the hub 12. In the case illustrated in FIGS. 1*a* and 1*b*, the axial flow fan 10 includes 7 blades 14. In the case illustrated in FIG. 2*a*, the axial flow fan 10 includes 4 blades 14.

The axial flow fan 10 of the present invention may further include an annular fan band 16 surrounding the blades 14 while connecting tips 14*b* of the blades 14 together.

Figure 1C:
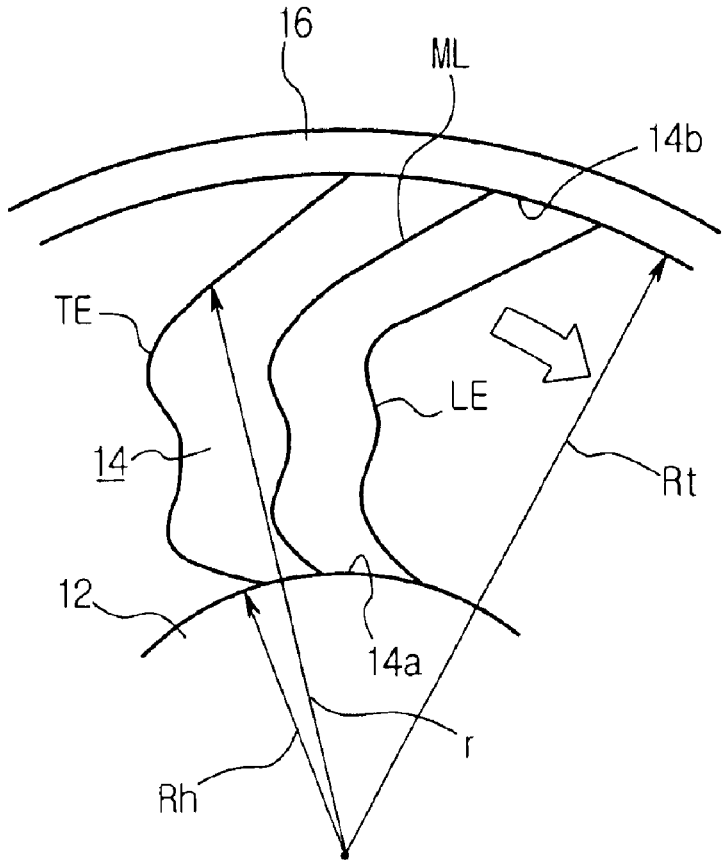
FIGS. 1*c* and 1*d* are enlarged views partially illustrating the blade shape of the axial flow fan shown in FIG. 1*b* in order to define respective elements of the axial flow fan.
Figure 1D:
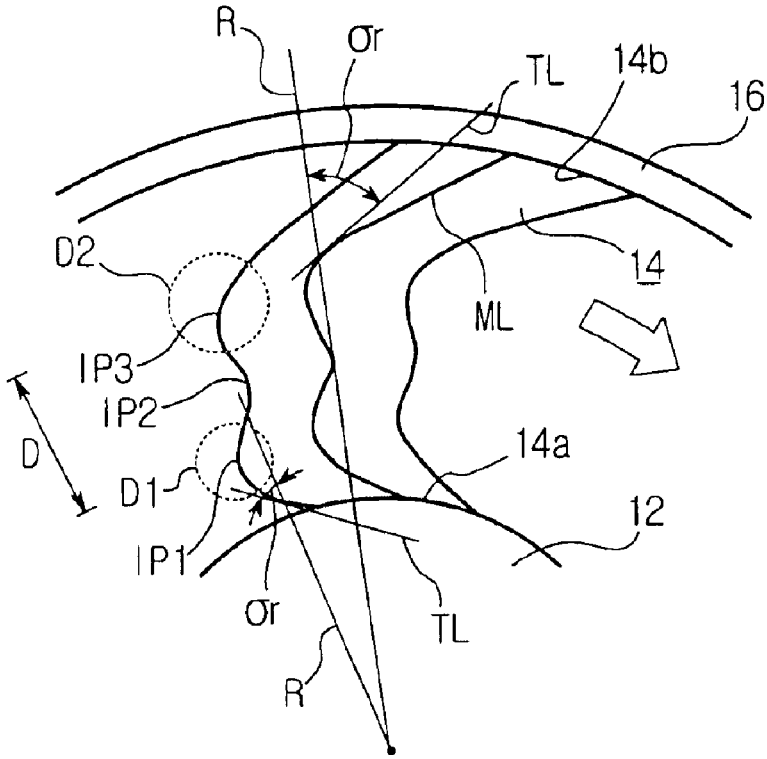
Figure 2A:
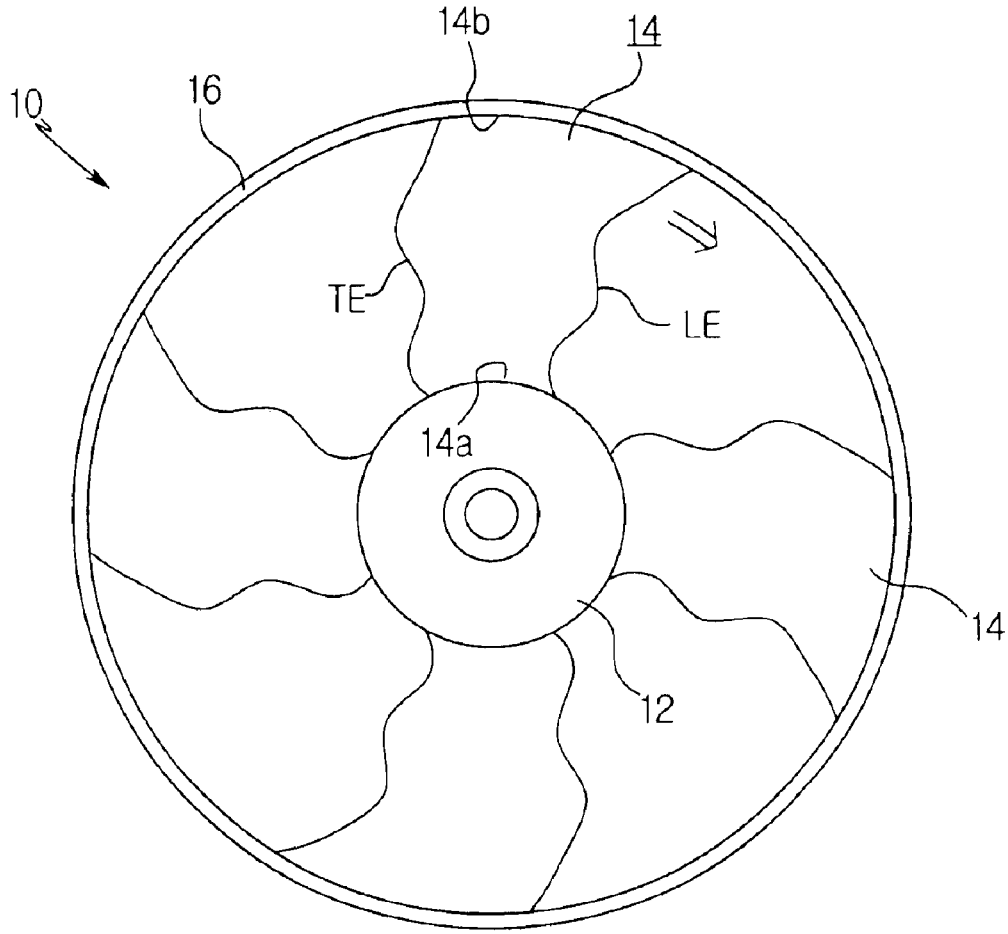
FIG. 2*a* is a front view illustrating an axial flow fan according to another embodiment of the present invention.
Figure 2B:
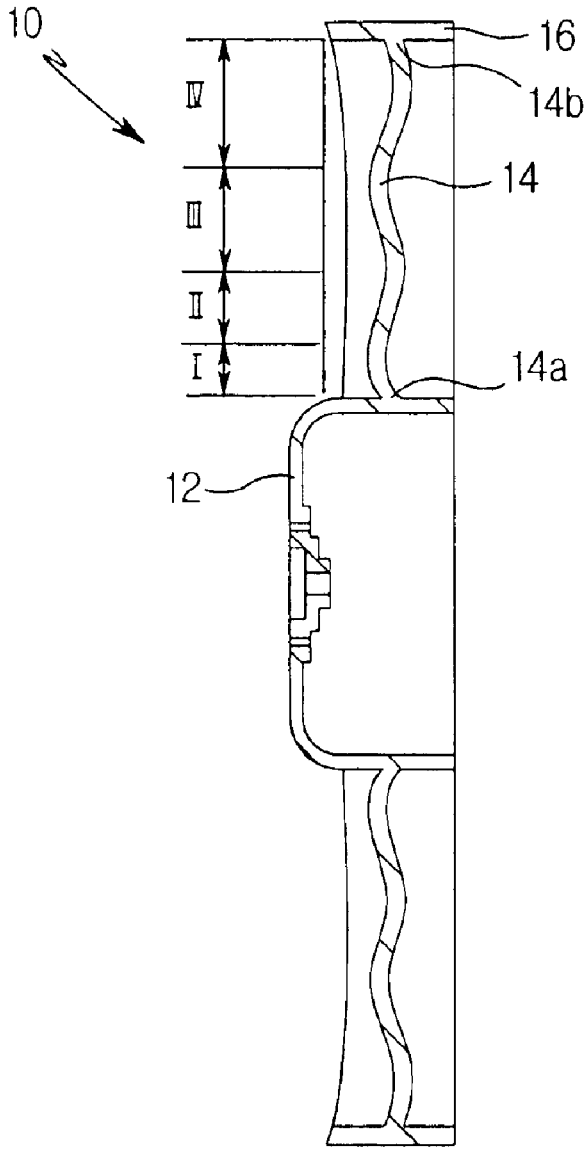
FIG. 2*b* is a sectional view corresponding to FIG. 2*a;*
Figure 2C:
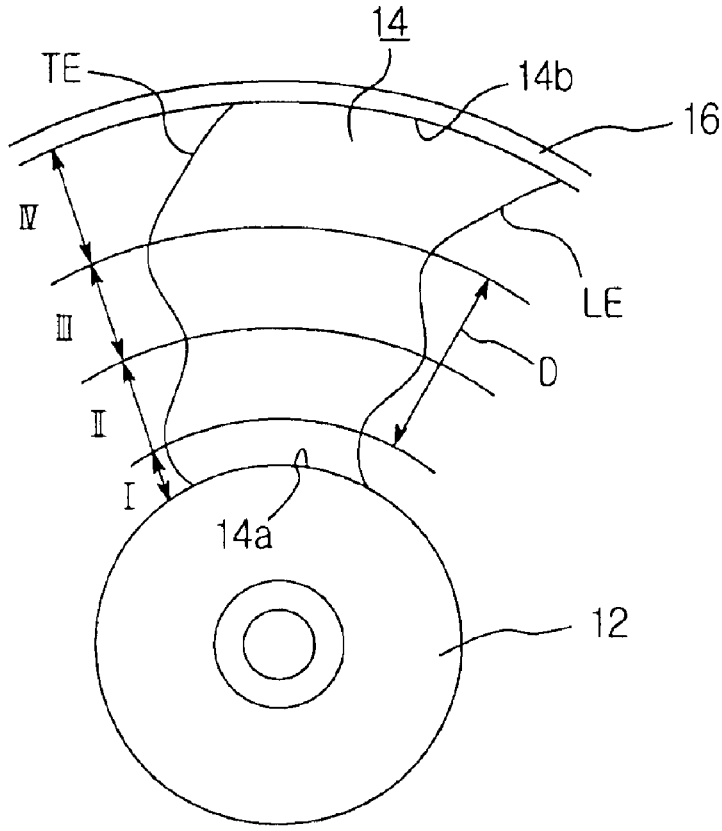
FIG. 2*c* is an enlarged view corresponding to a part of FIG. 2*a;*

As shown in FIGS. 1*c*, 1*d*, and 2*c*, each blade 14 of the axial flow of the axial flow fan 10 has a sweep angle $\sigma_r$, that is, an angle formed between a tangent line TL at an optional point on a leading edge LE of the blade 14, that is, the end of the blade 14 in a rotating direction, a trailing edge TE of the blade 14, that is, the end of the blade 14 in a direction opposite to the rotating direction, or a mid-chord line ML between the leading and trailing edges LE and TE, and a radius line R extending from the center of the hub 12 through the optional point. This sweep angle $\sigma_r$ is a factor representing the sweeping degree of the blade 14 in a rotating direction or a direction opposite to the rotating direction when viewed from the front of the axial flow fan. This factor is most importantly handled in designing axial flow fans because it has a great influence on blowing efficiency and generation of noise.

For example, when the sweep angle $\sigma_r$, of the blade in an axial flow fan is increased under the condition in which the other design conditions are constant, the axial flow fan exhibits a lower blowing efficiency while achieving reduction of noise. Accordingly, where the sweep angle $\sigma_r$, of the blade is increased under the same blowing design condition, consumption of electric power is increased because it is necessary to carry out rotation of the blade at a correspondingly increased speed. In this case, it is also necessary to increase the strength of the entire axial flow fan structure so that the axial flow fan can withstand the increased speed.

Taking into consideration such problems, blades 14 having a specific structure are used in accordance with the present invention. That is, as shown in FIGS. 1*d* and 2*c*, each blade 14 of the present invention has a sweep angle $\sigma_r$ varying gradually from a backward angle at the root 14*a* of the blade 14 secured to the hub 12 to a forward angle at the tip 14*b* of the blade 14 (for example, the blade portion connected to a fan band 16 where the fan band 16 is installed), as in conventional cases. In accordance with the present invention, however, the blade 14 has a flow dispersion region D having a plurality of regions where the sweep angle $\sigma_r$ of the blade is alternately changed from forward (+) to backward (−) or from backward to forward, between the backward sweep angle region at the blade root 14*a* and the forward sweep angle region at the blade tip 14*b*.

For example, each blade 14 is divided into four sections I to IV between the blade root 14*a* secured to the hub 12 and the blade tip 14*b*. The leading edge LE of the blade 14 has a sweep angle $\sigma_r$ alternating between forward (+) and backward (−) as it passes through the sections I to IV, so that it has a wave structure. Preferably, the trailing edge TE and mid-chord line ML of the blade 14 have a wave structure, as in the case of the leading edge LE.

The direction of the sweep angle $\sigma_r$ of the blade 14 will now be described. For example, the mid-chord line ML extends from the blade root 14*a* to the blade tip 14*b* while having a sweep angle $\sigma_r$ alternately changed in direction, starting from the backward direction at the blade root 14*a*, to have the forward direction at a first inflection point IP1, the backward direction at a second inflection point IP2, and the forward direction at a third inflection point IP3, so that the sweep angle $\sigma_r$ has the forward direction at the blade tip 14*b*. Such a change of the sweep angle $\sigma_r$ is also applied to the leading and trailing edges LE and TE in the same fashion. Accordingly, the blade 14 has a wave structure in its entirety.

The region between the first inflection point IP1 corresponding to a sweep direction change point near the blade root 14*a* and the third inflection point IP3 corresponding to a sweep direction change point near the blade tip 14*b* serves as the above described flow dispersion region D.

The flow dispersion region D is defined within the range of 0.15 to 0.75 of the non-dimensional radius as expressed by the following formula:

$$\text{Non-Dimensional Radius} = \frac{r - Rh}{Rt - Rh} \qquad \text{[formula]}$$

In the formula, "r" is the radial length from the center of the hub 12 to an optional point on the blade 14, "Rh" is the radius of the hub 12, and "Rt" is the radial length from the center of the hub 12 to the tip 14*b* of the blade 14, as shown in FIG. 1*c*.

The absolute value of the backward sweep angle within the flow dispersion region D corresponds to ⅔ or less of the absolute value of the forward sweep angle at the blade tip 14*b*. Also, the absolute value of the forward sweep angle within the flow dispersion region D corresponds to ⅔ or less of the absolute value of the backward sweep angle at the blade root 14*a*.

Figure 5:
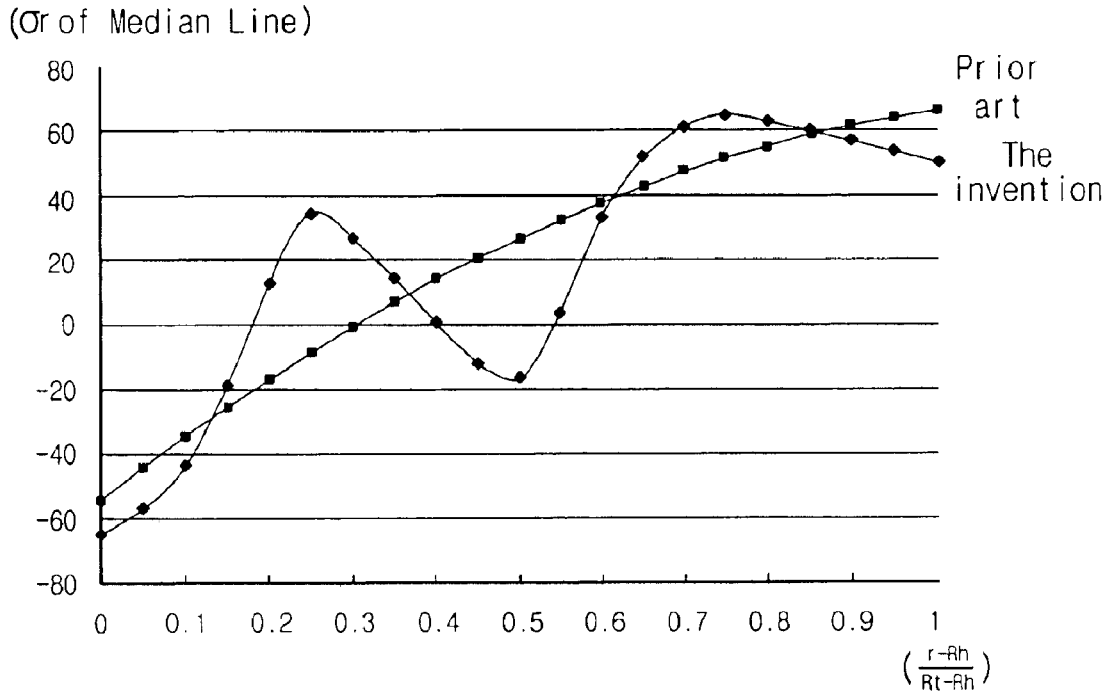
FIG. 5 is a graph depicting a variation in the sweep angle of the mid-chord line of each blade depending on a variation in non-dimensional radius in the axial flow fan according to the present invention and a conventional axial flow fan.

FIG. 5 is a graph depicting a variation in the sweep angle of the mid-chord line ML of each blade 14 depending on a variation in non-dimensional radius in the axial flow fan according to the present invention and a conventional axial flow fan.

Figure 9:
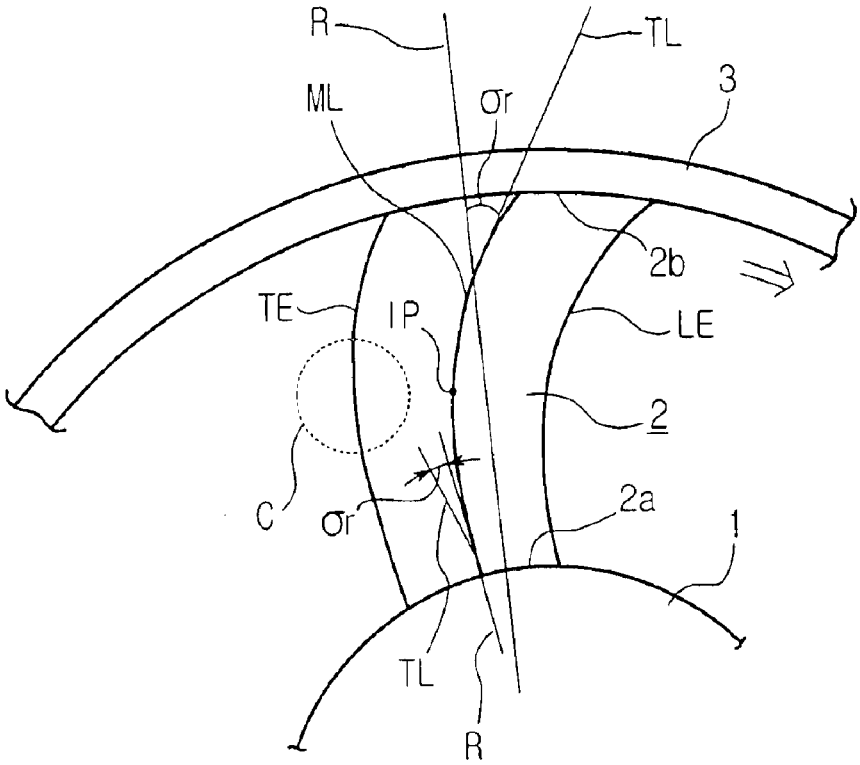
Fig. 9 Prior Art
FIG. 9 is an enlarged view corresponding to a part of FIG. 7.

As shown in FIG. 1*d*, the flow dispersion region D, which is defined between the root-side backward sweep region and the tip-side forward sweep region, serves to form, at the trailing edge TE of the blade, two flow concentration regions D1 and D2 where a flow of air is concentrated. Accordingly, the axial flow fan 10 of the present invention having two flow concentration regions D1 and D2 can greatly reduce concentration of air flow, as compared to the conventional axial flow fan in which only one flow concentration region (denoted by the reference character C in FIG. 9) is formed.

In detail, the axial flow fan of the present invention achieves reduction of blowing noise by optimizing a sweep angle of the blade 14 (that is, a reduction in blowing noise in accordance with an increased sweep angle) while receiving air in a flow-dispersed state at the wave-shaped leading edge LE, and discharging air in a flow-dispersed state at the wave-shaped trailing edge TE, by virtue of flow concentration regions D1 and D2, thereby causing reflective flows generated during the reception and discharge of air to be offset by each other at valley portions of the leading and trailing edges LE and TE.

Meanwhile, it is desirable that each blade 14 has a chord, that is, a distance between the leading and trailing edges LE and TE, gradually increasing as the blade 14 extends from the blade root 14*a* to the blade tip 14*b*. That is, the blade 14 preferably has a width gradually increasing as the blade 14 extends from the blade root 14*a* to the blade tip 14*b*.

Also, the longitudinal cross section of the blade 14 has a wave structure between the blade root 14*a* and the blade tip 14*b*. Preferably, the wave direction of the longitudinal blade cross section is alternately changed within the sections I to IV, as show in FIG. 2*b*. The wave-shaped longitudinal cross section of the blade 14 has a function suppressing a radial flow of air, thereby maximizing an axial flow of air. Thus, there is an advantage in that an improvement in blowing efficiency is achieved. Moreover, turbulent flows reflected from opposite sides of each valley portion in the wave-shaped longitudinal cross section of the blade 14 are offset by each other at an intermediate position of the valley portion, thereby reducing blowing noise.

Figure 3:
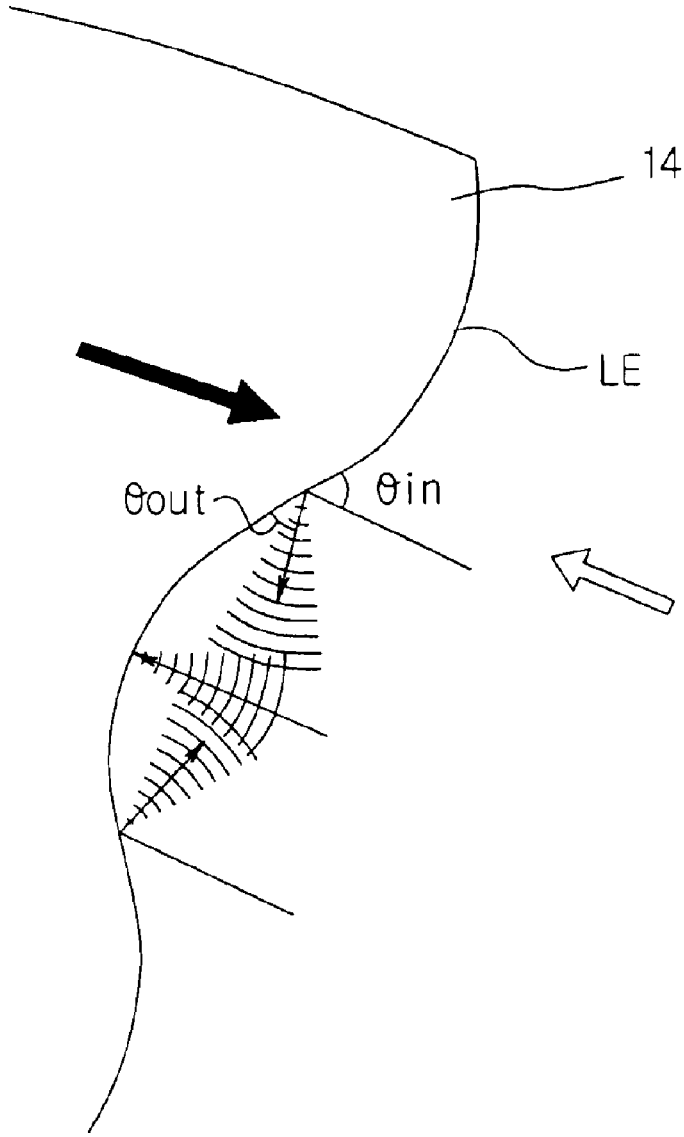
FIG. 3 is a schematic view illustrating an air flow state established by the axial flow fan of the present invention.

The functions of the axial flow fan 10 having the blades 14 with the above described structure in accordance with the present invention will now be described. The axial flow fan 10 of the present invention not only has a blowing noise reduction effect obtained by virtue of the optimized sweep angle $\sigma_r$ of the blade 14, but also a blowing noise reduction effect obtained as two waves reflected from opposite sides of each valley portion on the wave-shaped blade leading edge LE at a reflecting angle $\theta_{out}$ identical to an incident angle $\theta_{in}$ of air introduced at the leading edge LE are offset by each other, in accordance with Snell's Law, as shown in FIG. 3. Since an enhanced blowing noise reduction effect is obtained by offsetting reflective waves at the valley portion, blowing noise is considerably reduced for the same blown amount of air, as compared to conventional axial flow fans. In FIG. 3, the black arrow represents the rotating direction of the blade 14, whereas the white arrow represents the flow direction of air.

In accordance with the present invention, the axial flow fan 10 can variously change the flow angle and discharge position of air discharged from the trailing edge TE. Accordingly, it is possible to guide the flow of blown air without any interference with surrounding objects. Thus, it is possible to suppress generation of interference noise generated due to interference of the flow of discharged air with other objects.

In addition, in the axial flow fan 10 of the present invention, the radial flow of air is suppressed because each blade 14 has a wave-shaped longitudinal cross section. Accordingly, it is possible to maximize the axial flow of air, thereby achieving an improvement in blowing efficiency. Thus, a reduction in the consumption of electric power by the drive motor for the axial flow fan is achieved for the same blown air amount condition.

The above described noise reduction effect and blowing efficiency effect are obtained irrespective of whether or not the fan band 13 is used, and the direction (forward or backward direction) of the sweep angle $\sigma_r$ of the blade 14. These effects are obtained even when the wave-shaped flow dispersion region D is applied to only one of the leading and trailing edges LE and TE.

Figure 6:
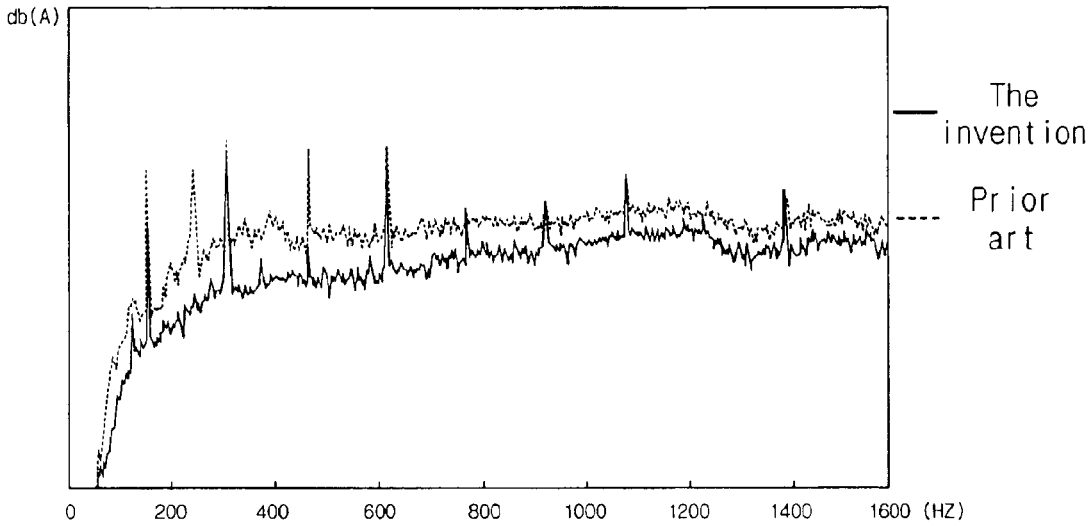
FIG. 6 is a graph depicting results of a comparison and analysis between the level of blowing noise generated by the axial flow fan of the present invention and the level of blowing noise generated by a conventional axial flow fan.
Figure 7:
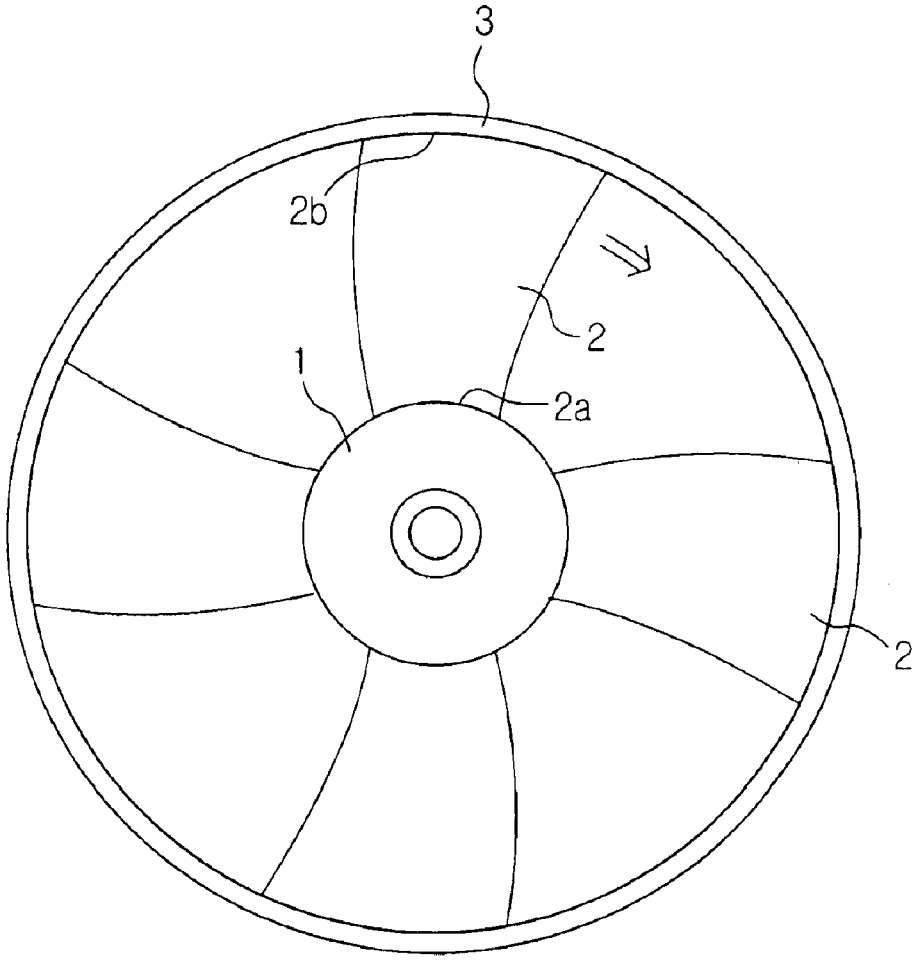
Fig. 7 Prior Art
FIG. 7 is a front view illustrating an example of a conventional axial flow fan.
Figure 8:
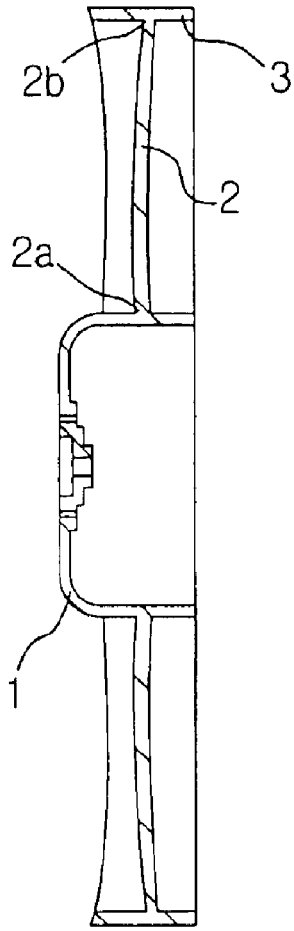
Fig. 8 Prior Art
FIG. 8 is a sectional view corresponding to FIG. 7.

FIG. 6 illustrates a graph depicting results of a comparison and analysis over a frequency range of 0 to 1,600 Hz, between the level of blowing noise generated by the axial flow fan of the present invention and the level of blowing noise generated by a conventional axial flow fan having forward blades. Referring to the graph, it can be seen that the axial flow fan 10 of the present invention has an advantage in that it exhibits reduction of broadband noise in a low frequency band, as compared to the conventional axial flow fan. Practically, the axial flow fan of the present invention consumes about 7% less power than the conventional axial flow fan for the same amount of blown air while generating at least 2 dB less overall sound pressure. In particular, analysis of the frequency component of noise has shown that the first blade passing frequency (BPF) is considerably reduced.

Figure 4A:
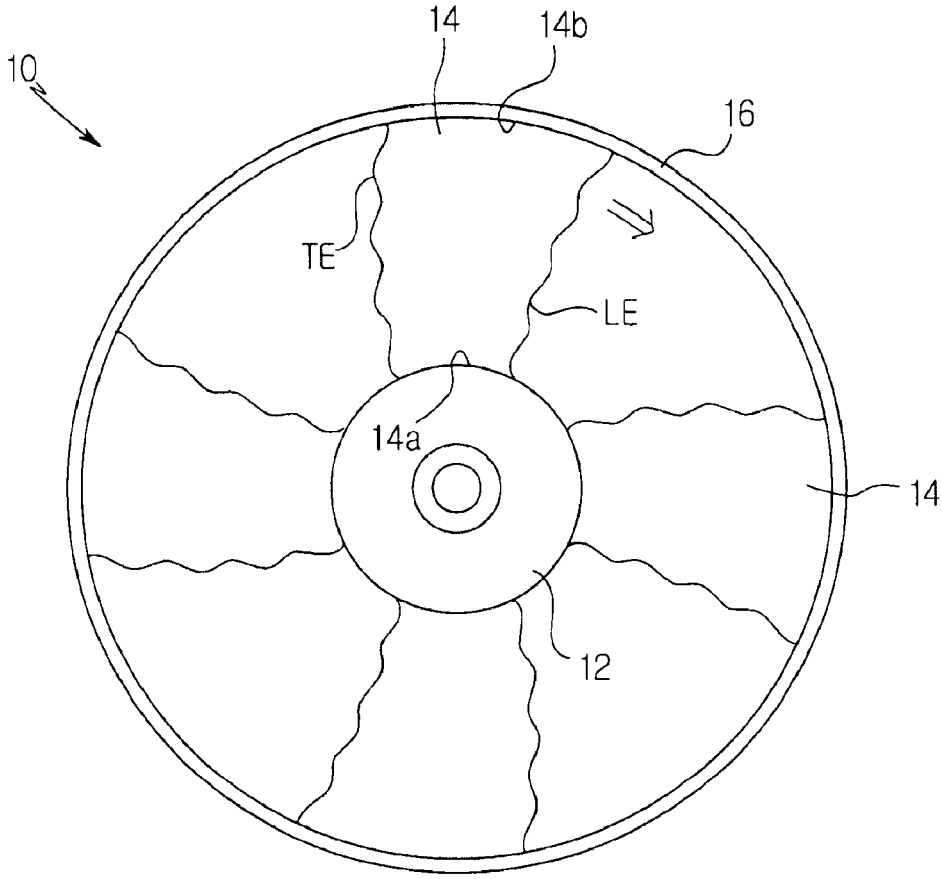
FIGS. 4*a* and 4*b* are a front view and a sectional view respectively illustrating an axial flow fan according to another embodiment of the present invention.
Figure 4B:
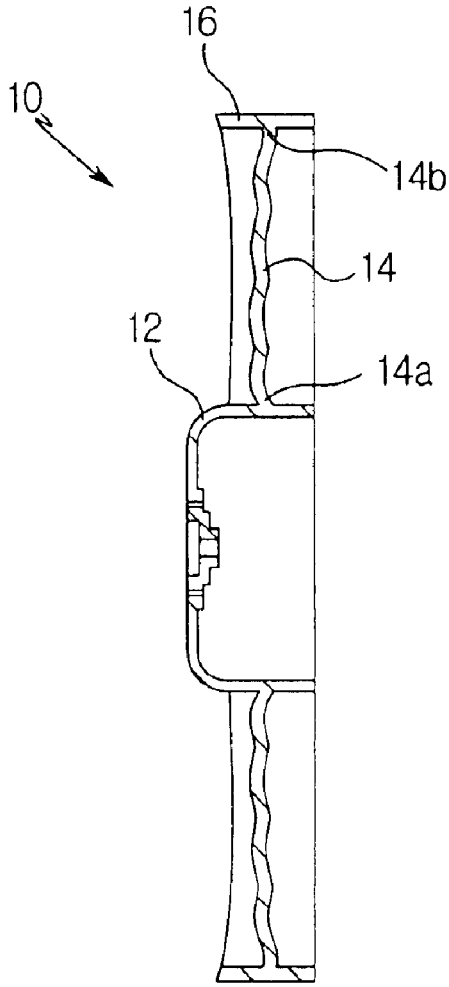

Meanwhile, FIGS. 4*a* and 4*b* are a front view and a side view respectively illustrating an axial flow fan according to another embodiment of the present invention. In the axial flow fan according to this embodiment, each blade 14 is divided into an increased number of sections (for example, 8 sections) between its root 14*a* and its tip 14*b*, as compared to the above described embodiment. Similarly to the above described embodiment, each blade 14 of this embodiment has leading and trailing edges LE and TE each having a wave structure with a sweep angle $\sigma_r$ alternating between forward (+) and backward (−) angles within the sections. Each blade 14 also has a wave-shaped longitudinal cross section extending between its root 14*a* and its tip 14*b*.

Since the axial flow fan of this embodiment has the same noise reduction principle and the same effect as those of the above described embodiment, no further description will be given.

In the axial flow fan of the present invention, each blade 14 may have a sweep angle $\sigma_r$ having a direction opposite to that of FIGS. 1*c* and 1*d*. This will be described without any separate illustration. In this case, each blade 14 of the axial flow fan has a sweep angle $\sigma_r$ varying gradually from a forward angle at the root 14*a* of the blade 14 to a backward angle at the tip 14*b* of the blade 14. The blade 12 also has a flow dispersion region D having a plurality of regions where the sweep angle $\sigma_r$ of the blade is alternately changed, between the forward sweep angle region at the blade root 14*a* and the backward sweep angle region at the blade tip 14*b*.

For example, the leading edge LE of the blade 14 extends from the blade root 14*a* to the blade tip 14*b*, and has a sweep angle $\sigma_r$ varying gradually from a maximum forward angle at the root 14*a* of the blade 14 to a maximum backward angle at the tip 14*b* of the blade 14 while being alternately changed in direction at an intermediate portion of the leading edge LE from a forward direction, corresponding to a sweep direction at the root of the blade, to a backward direction, and then from the backward direction to the forward direction, so that the sweep angle is finally changed from the forward direction to the backward direction corresponding to a sweep direction at the tip 14*b* of the blade 14. In this axial flow fan, inflection regions are formed near the blade root 14*a* and blade tip 14*b*, respectively. The region defined between the inflection regions serves as a flow dispersion region D.

As apparent from the above description, the present invention provides an axial flow fan capable of achieving reduction of noise by a flow dispersion region formed at each blade in accordance with a structure in which the sweep angle of the blade is alternately changed. Where a wave-shaped longitudinal cross-sectional structure is applied to the blade, it is possible to achieve a further noise reduction. Accordingly, an enhanced noise reduction effect is obtained, as compared to conventional axial flow fans. Thus, where the axial flow fan of the present invention is applied to a motor vehicle, it is possible to achieve a quiet running of the motor vehicle.

It is also possible to achieve control of the centrifugal force generated by each blade and discharge of air in a dispersed fashion at the trailing edge of the blade in accordance with the flow dispersion region, and an axial air guide by the wave-shaped longitudinal cross-sectional structure, thereby improving the blowing efficiency. Accordingly, the consumption of electric power of the drive motor for the axial flow fan can be reduced for the same amount of blown air. In addition, where the axial flow fan of the present invention is used to cool the heat exchanger of a motor vehicle, it can contribute to an improvement in the cooling performance of the heat exchanger while reducing the power consumption of the vehicle and achieving an improvement in the comfortableness of the motor vehicle.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. An axial flow fan including a hub, and a plurality of blades extending radially around the hub, wherein:

each of the blades has a sweep angle varying gradually from a backward angle at a root of the blade connected to the hub to a forward angle at a tip of the blade;

each of the blades has a flow dispersion region having a plurality of regions where the sweep angle is alternately changed, at a region defined between a backward sweep angle region at the root of the blade and a forward sweep angle region at the tip of the blade; and each of the blades has a leading edge extending from the root of the blade to the tip of the blade, and has a sweep angle varying gradually from a maximum backward angle at the root of the blade to a maximum forward angle at the tip of the blade while being alternately changed in direction at an intermediate portion of the leading edge from a backward direction, corresponding to a sweep direction at the root of the blade, to a forward direction, and then from the forward direction to the backward direction, so that the sweep angle is finally changed from the backward direction to the forward direction corresponding to a sweep direction at the tip of the blade.

2. The axial flow fan according to claim 1, wherein each of the blades has a trailing edge having the same sweep angle variation characteristics as those of the leading edge.

3. The axial flow fan according to claim 1, further comprising:

a fan band connecting tips of the blades.

4. The axial flow fan according to claim 1, wherein each of the blades has a width gradually increasing as the blade extends from its root to its tip.

5. The axial flow fan according to claim 1, wherein each of the blades has a longitudinal cross section curved to have a wave structure between the root of the blade and the tip of the blade.

6. The axial flow fan according to claim 1, wherein the absolute value of the forward sweep angle in the flow dispersion region on a mid-chord line between leading and trailing edges of the each of the blades corresponds to ⅔ or less of the absolute value of the backward sweep angle at the root of the blade.

7. The axial flow fan according to claim 6, wherein the absolute value of the backward sweep angle in the flow dispersion region corresponds to ⅔ or less of the absolute value of the forward sweep angle at the tip of the blade.

8. The axial flow fan according to claim 1, wherein the flow dispersion region of each of the blades is defined within a range of 0.15 to 0.75 of a non-dimensional radius expressed by the following expression:

$$\text{Non-Dimensional Radius} = \frac{r - Rh}{Rt - Rh}$$

where "r" is a radial length from a center of the hub to an optional point on the blade, "Rh" is a radius of the hub, and "Rt" is a radial length from the center of the hub to the tip of the blade.

9. An axial flow fan including a hub, and a plurality of blades extending radially around the hub, wherein:

each of the blades has a sweep angle varying gradually from a forward angle at a root of the blade to a backward angle at a tip of the blade; and each of the blades has a flow dispersion region having a plurality of regions where the sweep angle is alternately changed, at a region defined between a forward sweep angle region at the root of the blade and a backward sweep angle region at the tip of the blade.

10. The axial flow fan according to claim 9, wherein each of the blades has a leading edge extending from the root of the blade to the tip of the blade, and has a sweep angle varying gradually from a maximum forward angle at the root of the blade to a maximum backward angle at the tip of the blade while being alternately changed in direction at an intermediate portion of the leading edge from a forward direction, corresponding to a sweep direction at the root of the blade, to a backward direction, and then from the backward direction to the forward direction, so that the sweep angle is finally changed from the forward direction to the backward direction corresponding to a sweep direction at the tip of the blade.

11. An axial flow fan including a hub, and a plurality of blades extending radially around the hub, wherein:

each of the blades has a sweep angle varying gradually from a backward angle at a root of the blade connected to the hub to a forward angle at a tip of the blade;

each of the blades has a flow dispersion region having a plurality of regions where the sweep angle is alternately changed, at a region defined between a backward sweep angle region at the root of the blade and a forward sweep angle region at the tip of the blade; and each of the blades has a longitudinal cross section curved to have a wave structure between the root of the blade and the tip of the blade.

* * * * *